US007779765B2

(12) United States Patent
Donnell, Jr. et al.

(10) Patent No.: US 7,779,765 B2
(45) Date of Patent: Aug. 24, 2010

(54) PALLET WITH TELESCOPED LEG ASSEMBLIES

(75) Inventors: Emerson B. Donnell, Jr., Basking Ridge, NJ (US); Daniel Kelly, 9 Roxbury Dr., Medford, NJ (US) 08055

(73) Assignee: Daniel Kelly, Medford, NJ (US)

( * ) Notice: Subject to any disclaimer, the term of this patent is extended or adjusted under 35 U.S.C. 154(b) by 174 days.

(21) Appl. No.: 11/711,228

(22) Filed: Feb. 27, 2007

(65) Prior Publication Data

US 2007/0234933 A1 Oct. 11, 2007

Related U.S. Application Data

(60) Provisional application No. 60/779,056, filed on Mar. 3, 2006.

(51) Int. Cl.
*B65D 19/38* (2006.01)

(52) U.S. Cl. ..... 108/57.26; 108/56.1; 108/901

(58) Field of Classification Search ..... 108/56.1, 108/56.3, 57.25, 57.26, 901
See application file for complete search history.

(56) References Cited

U.S. PATENT DOCUMENTS

| | | | | |
|---|---|---|---|---|
| 2,699,912 | A | 1/1955 | Cushman | |
| 2,797,605 | A * | 7/1957 | Metze, Jr. et al. | 411/339 |
| 3,610,173 | A | 10/1971 | McIlwraith | |
| 3,664,271 | A * | 5/1972 | Wolder et al. | 108/57.26 |
| 3,696,761 | A | 10/1972 | Brown | |
| 3,736,834 | A | 6/1973 | MacDonald | |
| 3,760,547 | A | 9/1973 | Brenneman | |
| 3,824,933 | A | 7/1974 | Lind | |
| 3,835,792 | A | 9/1974 | Wharton | |
| 3,878,796 | A | 4/1975 | Morrison | |
| 3,910,202 | A | 10/1975 | Skahan | |
| 3,964,400 | A | 6/1976 | Brand | |
| 4,128,253 | A * | 12/1978 | Powers | 280/79.11 |
| 4,208,971 | A * | 6/1980 | Persson | 108/57.31 |
| 4,233,878 | A | 11/1980 | McGauran | |

(Continued)

FOREIGN PATENT DOCUMENTS

DE 21 25 549 12/1972

(Continued)

OTHER PUBLICATIONS

European Search Report Corresponding to Application No. EP. 07075167 dated Jun. 12, 2007.

*Primary Examiner*—Hanh V Tran
(74) *Attorney, Agent, or Firm*—RatnerPrestia

(57) ABSTRACT

A pallet having first and second decks with at least two post assemblies extending between the first and second decks to maintain the first and second decks at a distance from one another. Each post assembly includes an outer post member including a substantially hollow body extending axially from a base connected to the first deck to a free end and an inner post member including a body extending axially from a base connected to the second deck to a free end. The inner post body free end is configured to be received in the outer post body with the inner and outer posts positioned relative to one another such that at least one of the post free ends contacts the respective opposed deck and supports the first and second decks in spaced relationship.

21 Claims, 18 Drawing Sheets

U.S. PATENT DOCUMENTS

| | | | | | |
|---|---|---|---|---|---|
| 4,267,781 | A | * | 5/1981 | Powers | 108/56.1 |
| 4,597,338 | A | | 7/1986 | Kreeger | |
| 4,604,014 | A | | 8/1986 | Frano | |
| 4,735,154 | A | * | 4/1988 | Hemery | 108/56.1 |
| 5,195,439 | A | * | 3/1993 | Harder | 108/57.12 |
| 5,197,395 | A | | 3/1993 | Pigott et al. | |
| D347,511 | S | | 5/1994 | Pigott | |
| 5,343,814 | A | | 9/1994 | Pigott | |
| 5,351,629 | A | | 10/1994 | Breezer | |
| 5,483,899 | A | * | 1/1996 | Christie | 108/56.3 |
| 5,513,577 | A | | 5/1996 | Weis | |
| 5,528,995 | A | | 6/1996 | Lim | |
| 5,555,820 | A | | 9/1996 | Shuert | |
| 5,579,686 | A | | 12/1996 | Pigott | |
| 5,588,371 | A | * | 12/1996 | Looker | 108/57.12 |
| 5,603,266 | A | | 2/1997 | Nash | |
| 5,676,064 | A | | 10/1997 | Shuert | |
| 5,791,261 | A | | 8/1998 | John | |
| 5,794,543 | A | | 8/1998 | John | |
| 5,809,905 | A | | 9/1998 | John | |
| 5,860,369 | A | | 1/1999 | John et al. | |
| 5,887,529 | A | | 3/1999 | John et al. | |
| 6,006,677 | A | | 12/1999 | Apps et al. | |
| 6,021,721 | A | * | 2/2000 | Rushton | 108/56.3 |
| 6,026,958 | A | | 2/2000 | Kelly | |
| 6,029,583 | A | * | 2/2000 | LeTrudet | 108/57.25 |
| 6,109,190 | A | | 8/2000 | Hale et al. | |
| 6,123,492 | A | | 9/2000 | Pickard | |
| 6,142,300 | A | | 11/2000 | Kelly et al. | |
| 6,173,659 | B1 | * | 1/2001 | Danks et al. | 108/54.1 |
| 6,230,385 | B1 | | 5/2001 | Nelson | |
| 6,263,807 | B1 | | 7/2001 | Fox et al. | |
| 6,283,044 | B1 | | 9/2001 | Apps | |
| 6,418,862 | B1 | * | 7/2002 | Heil | 108/57.12 |
| 6,446,563 | B1 | * | 9/2002 | Ohanesian | 108/57.25 |
| 6,564,725 | B2 | | 5/2003 | Hale | |
| 6,622,641 | B2 | | 9/2003 | Smyers | |
| 6,644,219 | B2 | | 11/2003 | Apps | |
| 6,718,888 | B2 | | 4/2004 | Muirhead et al. | |
| 6,742,460 | B2 | * | 6/2004 | Meyer et al. | 108/57.25 |
| 6,805,061 | B2 | | 10/2004 | Smyers et al. | |
| 6,811,042 | B2 | | 11/2004 | Kelly et al. | |
| 6,840,181 | B2 | | 1/2005 | Smyers | |
| 6,886,475 | B2 | | 5/2005 | Apps et al. | |
| 6,955,129 | B2 | | 10/2005 | Moore, Jr. | |
| 2003/0061974 | A1 | | 4/2003 | Smyers | |
| 2003/0070593 | A1 | | 4/2003 | Halavais | |
| 2003/0136314 | A1 | | 7/2003 | Smyers | |
| 2003/0233963 | A1 | | 12/2003 | Fan | |
| 2004/0069190 | A1 | | 4/2004 | Smyers | |
| 2004/0177791 | A1 | | 9/2004 | Lawson | |
| 2004/0187745 | A1 | | 9/2004 | Rojas | |
| 2004/0245248 | A1 | | 12/2004 | Shuert | |
| 2004/0251154 | A1 | | 12/2004 | Kulbeth et al. | |
| 2005/0081763 | A1 | | 4/2005 | Ramirez | |
| 2007/0151488 | A1 | * | 7/2007 | Schader | 108/51.3 |
| 2007/0186826 | A1 | * | 8/2007 | Kuo | 108/56.3 |

FOREIGN PATENT DOCUMENTS

| | | | | |
|---|---|---|---|---|
| DE | 94 00 733 | | 3/1994 | |
| FR | 2 639 911 | | 6/1990 | |
| FR | 2703326 | * | 10/1994 | 108/56.1 |
| WO | WO 99/02412 | | 1/1999 | |
| WO | WO 2005/118412 | | 12/2005 | |
| WO | WO 2006/014857 | | 2/2006 | |

* cited by examiner

FIG. 10
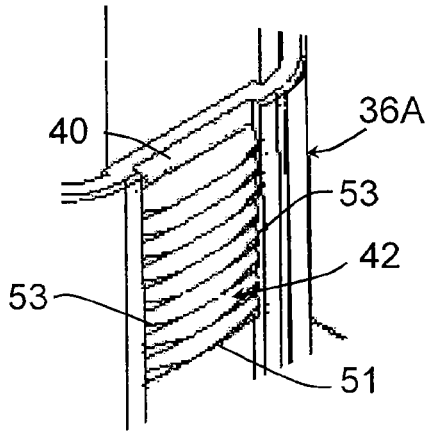
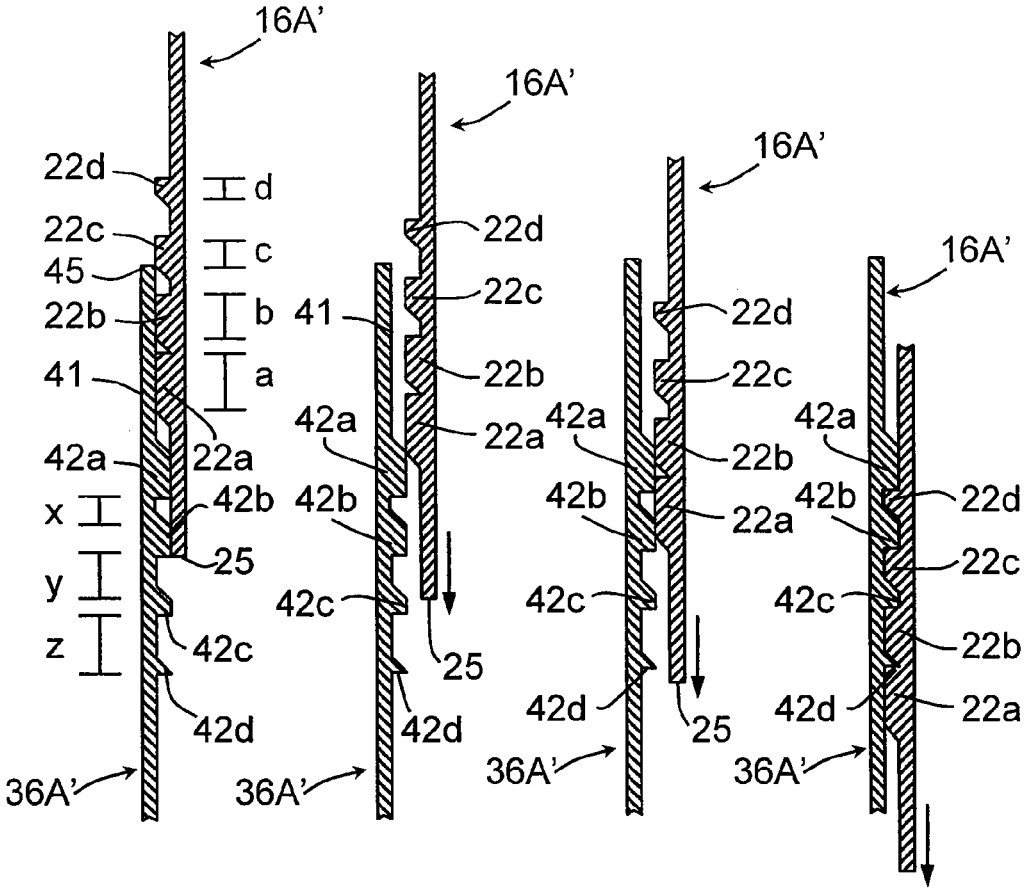
FIG. 11A FIG. 11B FIG. 11C FIG. 11D

PALLET WITH TELESCOPED LEG ASSEMBLIES

This application claims the benefit of U.S. Provisional Application No. 60/779,056, filed on Mar. 3, 2006.

BACKGROUND OF THE INVENTION

The present invention relates to pallets. More particularly, the present invention relates to a pallet having top and bottom decks with a plurality of telescoped leg assemblies extending therebetween.

Fork-lift pallets have been in wide use for many years to minimize the cost of handling products or articles that can be stacked or otherwise secured on them to thus enable large volumes of products or articles to be handled simultaneously and to be handled in mechanized fashion so as to minimize labor costs. Historically, fork-lift pallets have been constructed of wood, having a plurality of parallel stringers on which are nailed or otherwise secured one or more structural members defining a pallet platform. The pallet platform can be composed of multiple wood strips or unitary wood panels, such as plywood panels, to provide a generally planar support surface on which the goods or articles are appropriately arranged or stacked. The parallel stringers raise the product support platform above a floor surface and thereby permit the forks of a fork-lift truck to be inserted within spaces defined between the stringers. This enables a fork-lift truck to lift and move the pallet with all of its articles as a unit or package. Typically, the pallet will remain with the products or articles until such time as the articles are removed from the pallet for further handling, for use or for distribution.

Even though pallets are typically of low cost, they are sufficiently costly that they are used many times for shipment of products before they become sufficiently worn or damaged that replacement is necessary. Although wood has historically been a low cost commodity, thus enabling pallets to be manufactured of wood at low cost, of late, the cost of wood for products such as pallets has significantly increased, thus causing pallet manufacturers to seek other sources for materials. Pallets have been constructed of extruded or formed metal such as steel or aluminum. Pallets have also been constructed of molded or extruded plastic materials, including virgin plastic material or plastic material that has been recycled or reclaimed from waste.

Plastic pallets are often difficult to manufacture and assemble due to the complexity and/or number of parts. Additionally, plastic pallets are often subject to excessive wear or failure, particularly at points of interconnection or at support posts which are most susceptible to contact from fork-lift tines or the like.

It is desirable to provide a pallet construction wherein the pallet is easy to manufacture and assemble while providing a desired stability and durability.

SUMMARY OF THE INVENTION

In at least one aspect, the present invention provides a pallet comprising first and second decks with at least two post assemblies extending between the first and second decks to maintain the first and second decks at a distance from one another. Each post assembly comprises an outer post member including a substantially hollow body extending axially from a base connected to the first deck to a free end and an inner post member including a body extending axially from a base connected to the second deck to a free end. The inner post body free end is configured to be received in the outer post body with the inner and outer posts positioned relative to one another such that at least one of the post free ends contacts the respective opposed deck and supports the first and second decks in spaced relationship.

In another aspect of the invention, a groove is provided about at least a portion of the perimeter of the inner post base. The groove is configured to receive and radially retain at least a portion of the perimeter of the outer post free end.

In another aspect of the invention, the outer post body has an interior surface with at least one set of barbs thereon with each barb defining a flat engagement surface facing toward its base and the inner post body has an exterior surface with at least one set of barbs thereon with each barb defining a flat engagement surface facing toward its base. The inner post body and the outer post body are positioned relative to one another such that the outer post barb flat engagement surfaces engage the inner post barb flat engagement surfaces such that axial separation between the inner and outer post members is prevented.

BRIEF DESCRIPTION OF THE DRAWINGS

FIG. 10 is an expanded view of the barb portion of the inner post member of FIG. 6.

FIGS. 11A-11D are partial cross-sectional views illustrating the operation of an alternative post assembly.

DETAILED DESCRIPTION OF THE INVENTION

Figure 1:
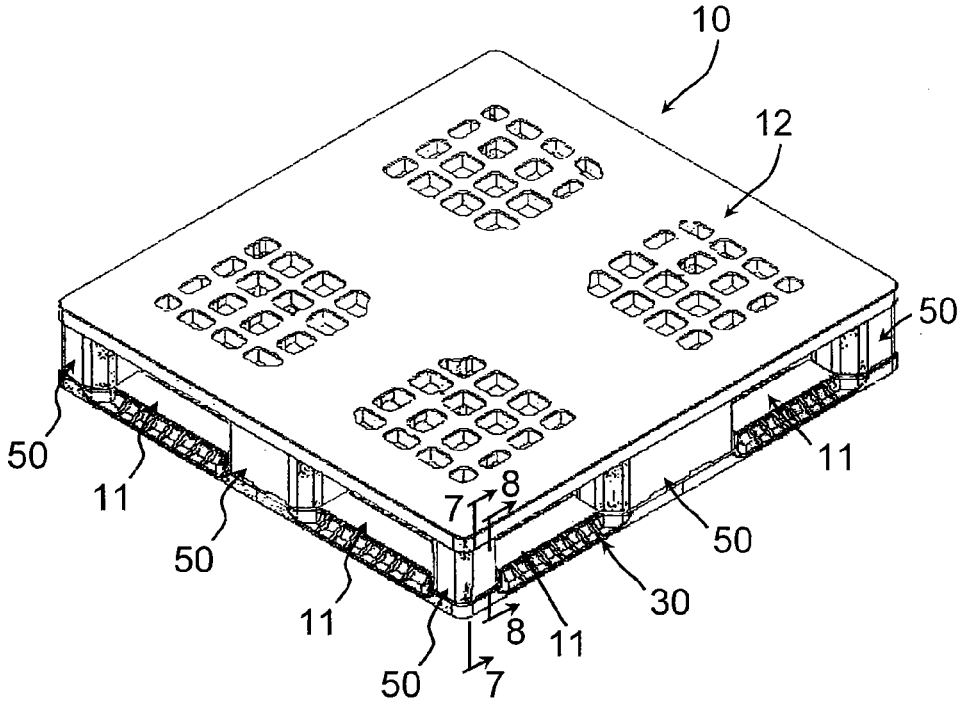
FIG. 1 is an isometric view of a pallet that is a first embodiment of the present invention.

Although the invention is illustrated and described herein with reference to specific embodiments, the invention is not intended to be limited to the details shown. Rather, various modifications may be made in the details within the scope and range of equivalents of the claims and without departing from the invention.

Referring to FIGS. 1-3 and 5-10, a pallet 10 that is a first embodiment of the present invention will be described. The pallet 10 generally comprises a top deck 12 interconnected to a bottom deck 30 via a plurality of post assemblies 50. The post assemblies 50 maintain the top deck 12 and bottom deck 30 in spaced relationship such that fork receiving openings 11 are defined along each lateral edge of the pallet 10 between the post assemblies 50. The present embodiment includes nine post assemblies 50, but may include more or fewer post assemblies 50.

Figure 2:
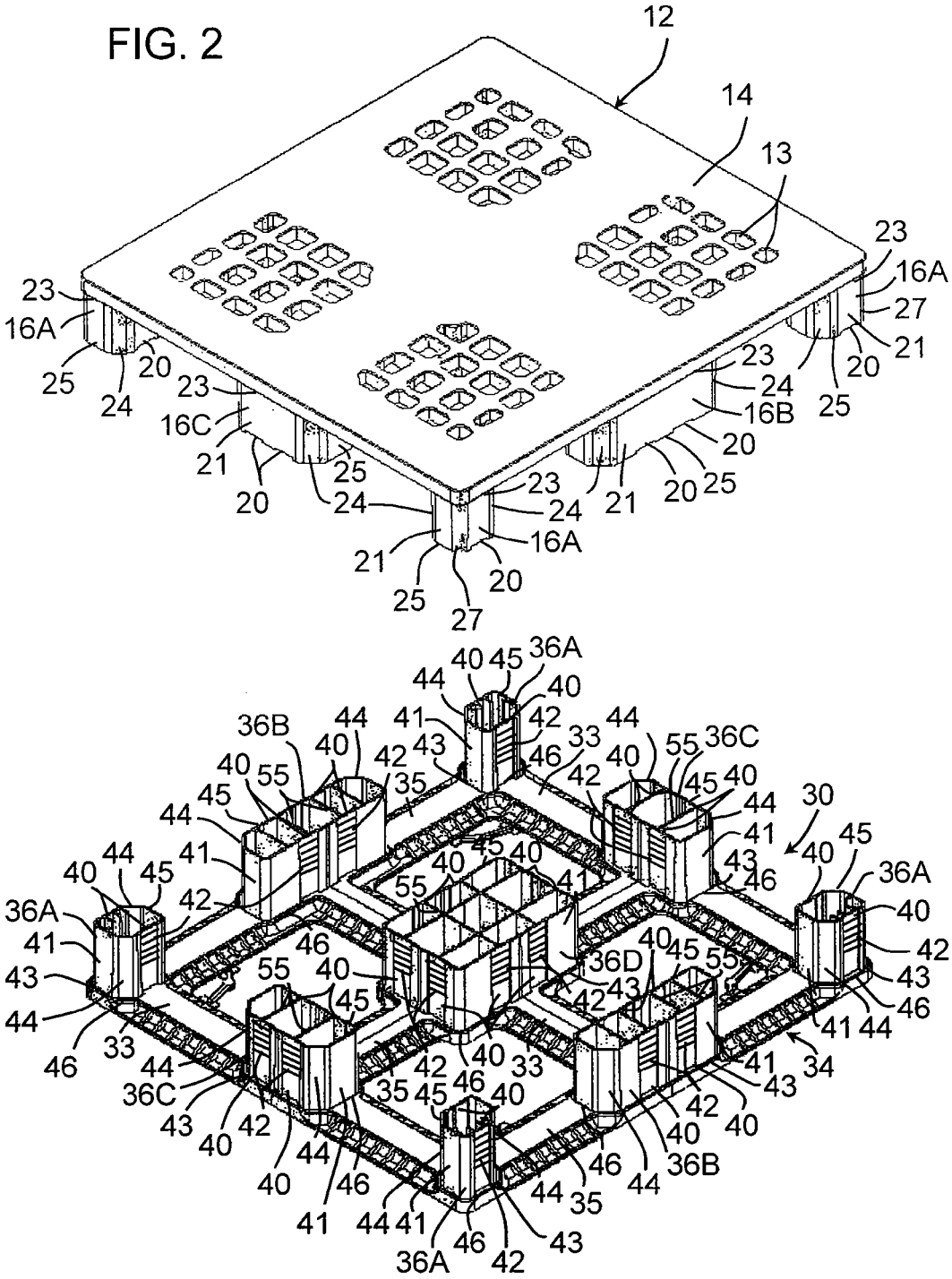
FIG. 2 is an exploded, top isometric view of the pallet of FIG. 1.
Figure 3:
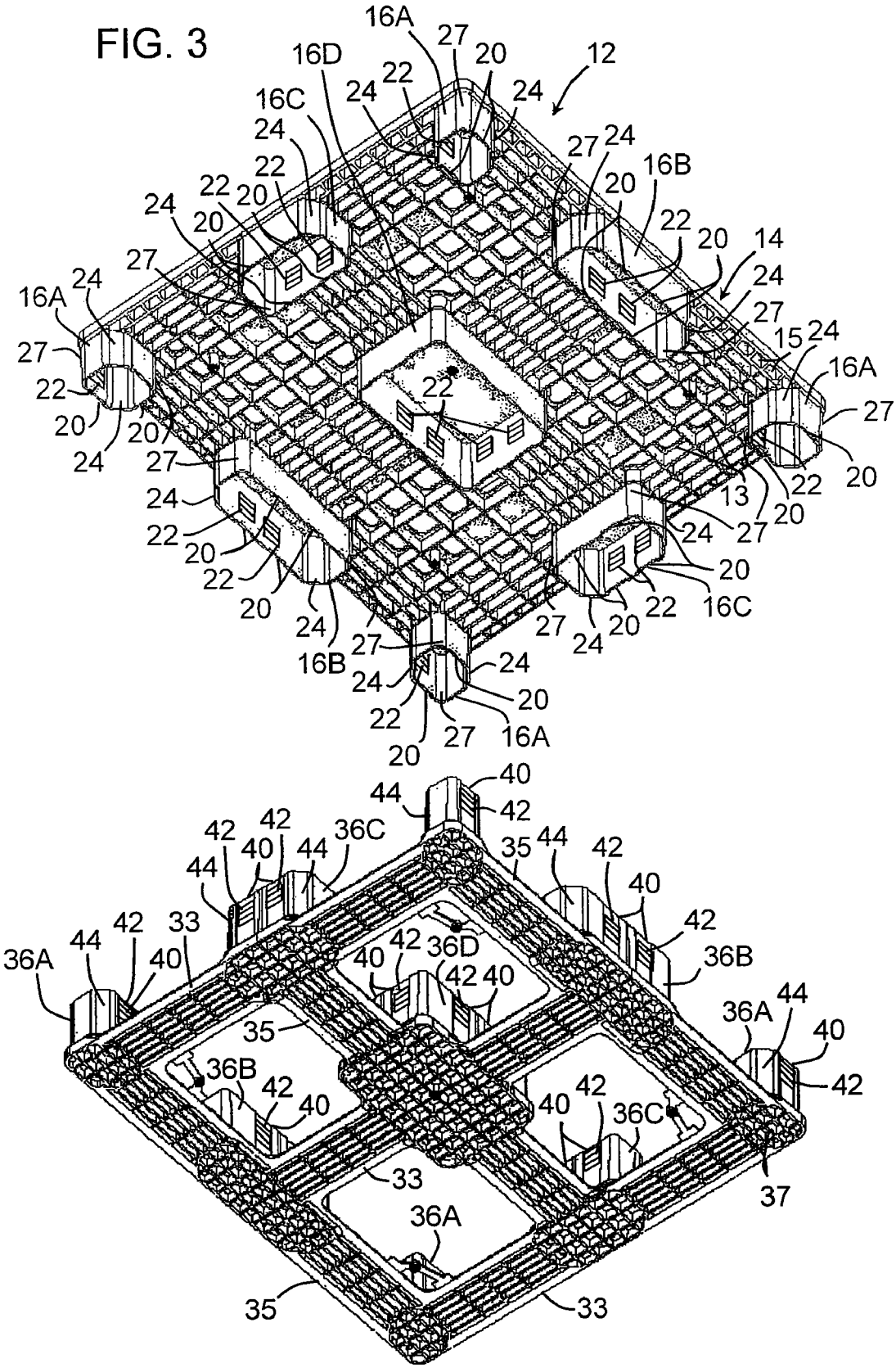
FIG. 3 is an exploded, bottom isometric view of the pallet of FIG. 1.
Figure 4:
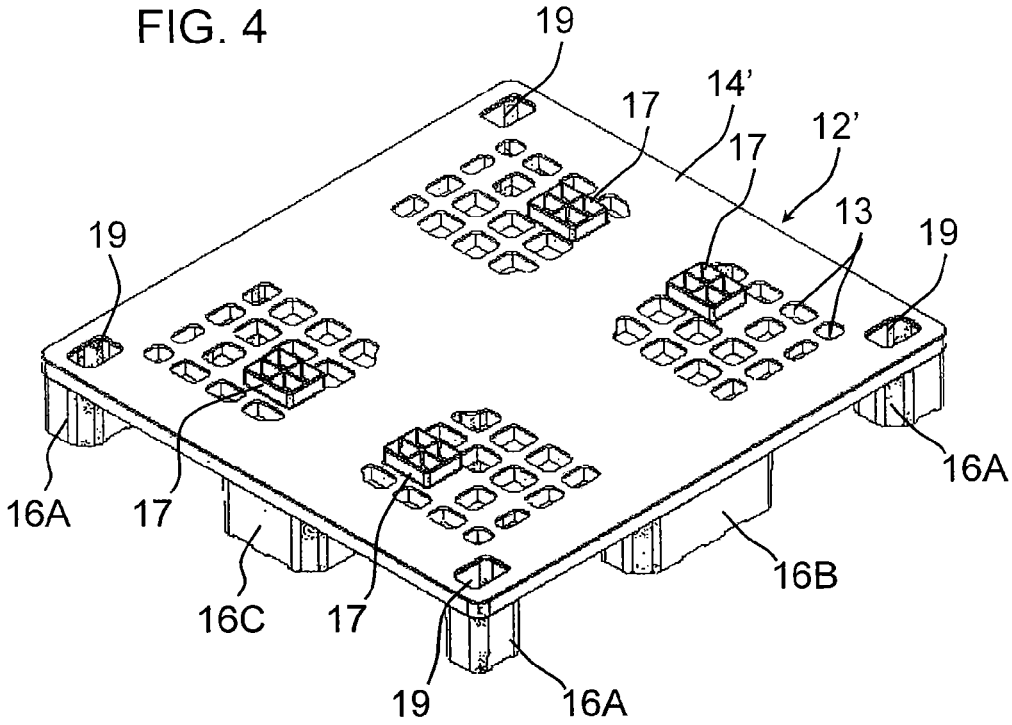
FIG. 4 is a top isometric view of an alternative top deck according to the present invention.

Referring to FIGS. 2 and 3, the top deck 12 of the present embodiment includes a generally planar surface 14 supported by an interconnected rib structure 15. The top deck 12 may be a solid surface, but the rib structure 15 is generally preferred as it reduces weight and material cost. The surface 14 preferably includes a plurality of through holes 13 to facilitate passage of water, debris and the like through the pallet top deck 12. In the alternative top deck 12' illustrated in FIG. 4, a plurality of cleats 17 extend upward from the surface 14' and are configured to interconnect with racks or the like positioned on the pallet. The alternative top deck 12' also includes a plurality of slots 19 configured to receive legs or cleats of a rack or the like positioned on the pallet. As illustrated in FIG. 4, the slots 19 may be aligned with the corner outer post members 16A such that the leg or cleat is partially received within the post assembly 50 of the pallet. The slots 19 may be otherwise positioned if it is desired to maintain the post assemblies 50 generally sealed as will be described hereinafter. The top deck 12 is not limited to the illustrated embodiments and may have various other configurations for accommodating and supporting various cargo and rack structures.

The bottom deck 30 preferably includes a first series of plank members 33 interconnected with a second series of plank members 35 extending orthogonal thereto to form a grid structure 34. While the illustrated structure is preferred, the bottom deck 30 may include more or fewer planks, or alternatively, be a planar structure similar to the top deck 12. The plank members 33, 35 again preferably include a supporting rib structure 37, but are not limited to such a configuration. In the preferred embodiment, the planks 33 and 35 are formed interconnected as a unitary grid structure 34, but may alternatively be formed as individual components thereafter interconnected.

Each post assembly 50 is defined by an outer post member, and an inner post member configured to be telescopingly received in the outer post member. In the present embodiments, the outer post members 16A-16D are illustrated as being integral with the top deck 12 while the inner post members 36A-36D are illustrated as being integral with the bottom deck 30. Alternative configurations are within the scope of the invention. For example, the configuration may be reversed such that each of the outer post members extends from the bottom deck 30 while each of the inner post members extends from the top deck 12. Alternatively, the configuration may be combined such that some of the outer post members extend from the top deck 12 and align with inner post members extending from the bottom deck 30 while other outer post members extend from the bottom deck 30 and align with inner post members extending from the top deck 12. The top and bottom decks 12, 30 are preferably integrally molded with the post members. Various molding techniques, for example, but not limited to, injection molding or gas assist injection molding, may be utilized. Additionally, the decks 12 and 30 and post assemblies can be manufactured from any suitable material, including, plastics, reinforced plastics and various other natural or synthetic materials.

In the present embodiment of the pallet 10, the top deck 12 includes four outer post members 16A, each extending from a respective corner of the top deck 12, two outer post members 16B extending from opposed lateral sides of the top deck 12, two outer post members 16C extending from the remaining opposed lateral sides of the top deck 12, and a central outer post member 16D. Each outer post member 16A-16D has a similar general construction with a perimeter wall 21 extending between a base portion 23 attached to the surface 14 and a free end 25, see FIGS. 2 and 5. The outer post members 16A-16D may all have the same shape or may have different shapes as in the illustrated embodiments. Referring to FIGS. 2 and 3, the outer post members 16A each have a generally square configuration with opposed rounded corners 27 and opposed tapered corners 24. The tapered corners 24 are preferably at an approximately 45° angle and are configured to align with the fork receiving openings 11 to provide a funnel shape into the opening. The outer post members 16B and 16C are generally rectangular structures with rounded inside corners 27 and tapered outside corners 24. Again, the tapered corners 24 are aligned with the fork receiving openings 11 to provide a funnel shape into the opening. The central outer post member 16D has a generally rectangular configuration with rounded corners 27. The central member 16D is spaced from the openings 11 and generally does not require tapered corners. While specific shapes and configurations are illustrated, the outer post members 16A-16B are not limited to these configurations and may have various configurations.

Figure 5:
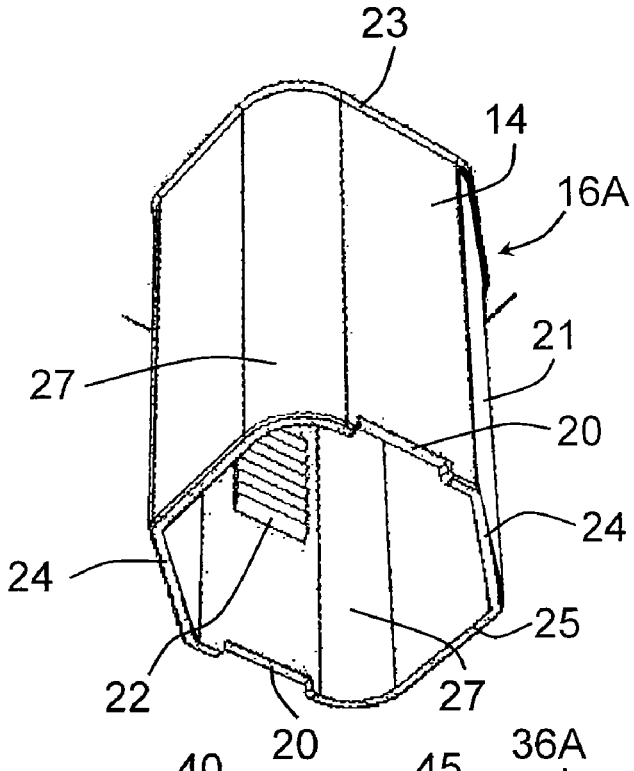
FIG. 5 is a bottom isometric view of an illustrative outer post member.

The inner post members 36A-36D generally correspond to the respective outer post members 16A-16D and include a perimeter wall 41 extending between a base portion 43 attached to the grid structure 34 and a free end 45, see FIGS. 2 and 5. The outer post members 16A-16D may all have the same shape or may have different shapes as in the illustrated embodiments. Referring to FIGS. 2 and 3, the inner post members 36A correspond to outer post members 16A and each have a generally square configuration with opposed rounded corners and opposed tapered corners 44. The inner post members 36B and 36C correspond to outer post members 16B and 16C and are generally rectangular structures with rounded inside corners and tapered outside corners 44. The central inner post member 36D corresponds to outer post members 16D and has a generally rectangular configuration with rounded corners.

Referring to FIGS. 5-10, features of the post assemblies 50 will be described in more detail with reference to an outer post member 16A and an inner post member 36A. The other outer post members 16B-16D and the other inner post members 36B-36D have similar features which are numbered similarly in FIGS. 2 and 3. Reference to FIGS. 2 and 3 illustrates the number and position of such features on the other outer post members 16B-16D and the other inner post members 36B-36D.

Figure 6:
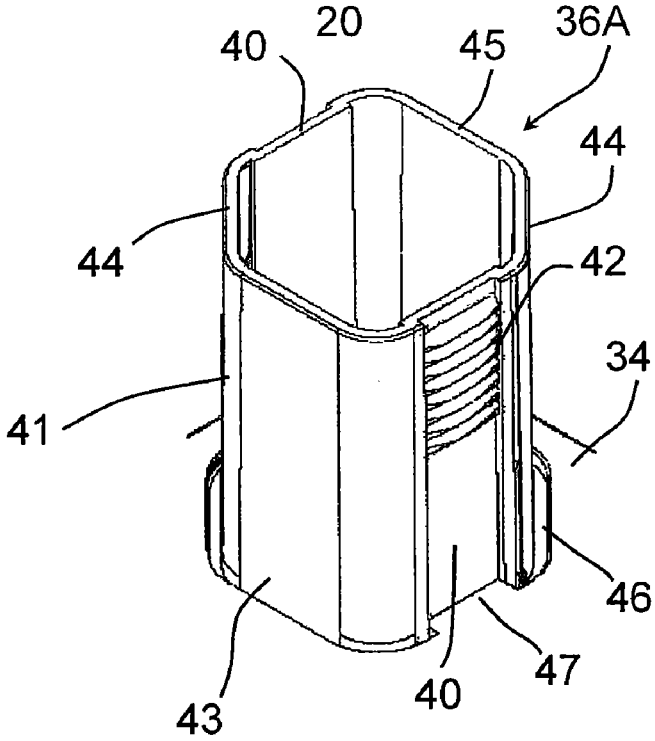
FIG. 6 is a top isometric view of an illustrative inner post member.
Figure 7:
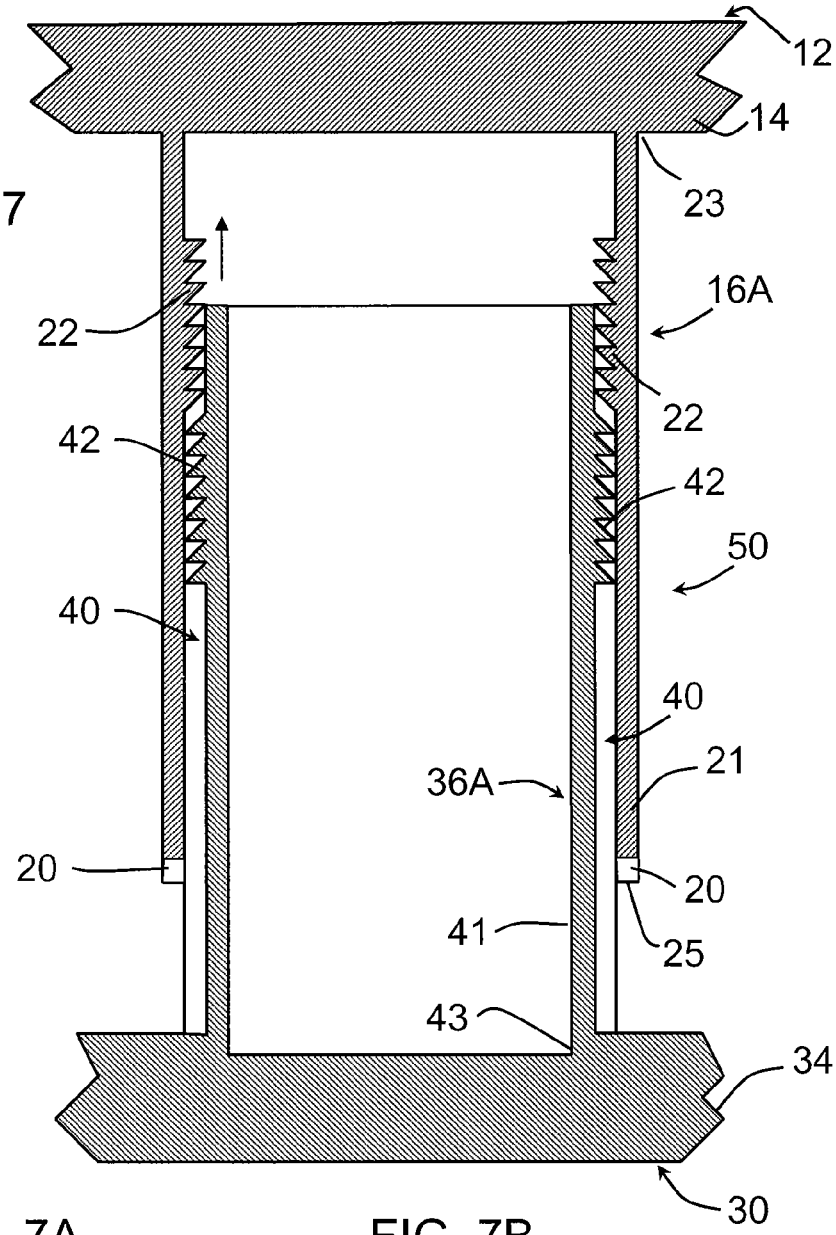
FIG. 7 is a cross-sectional view of along the line 7-7 in FIG. 1 with the top and bottom decks positioned prior to assembly.
Figure 8:
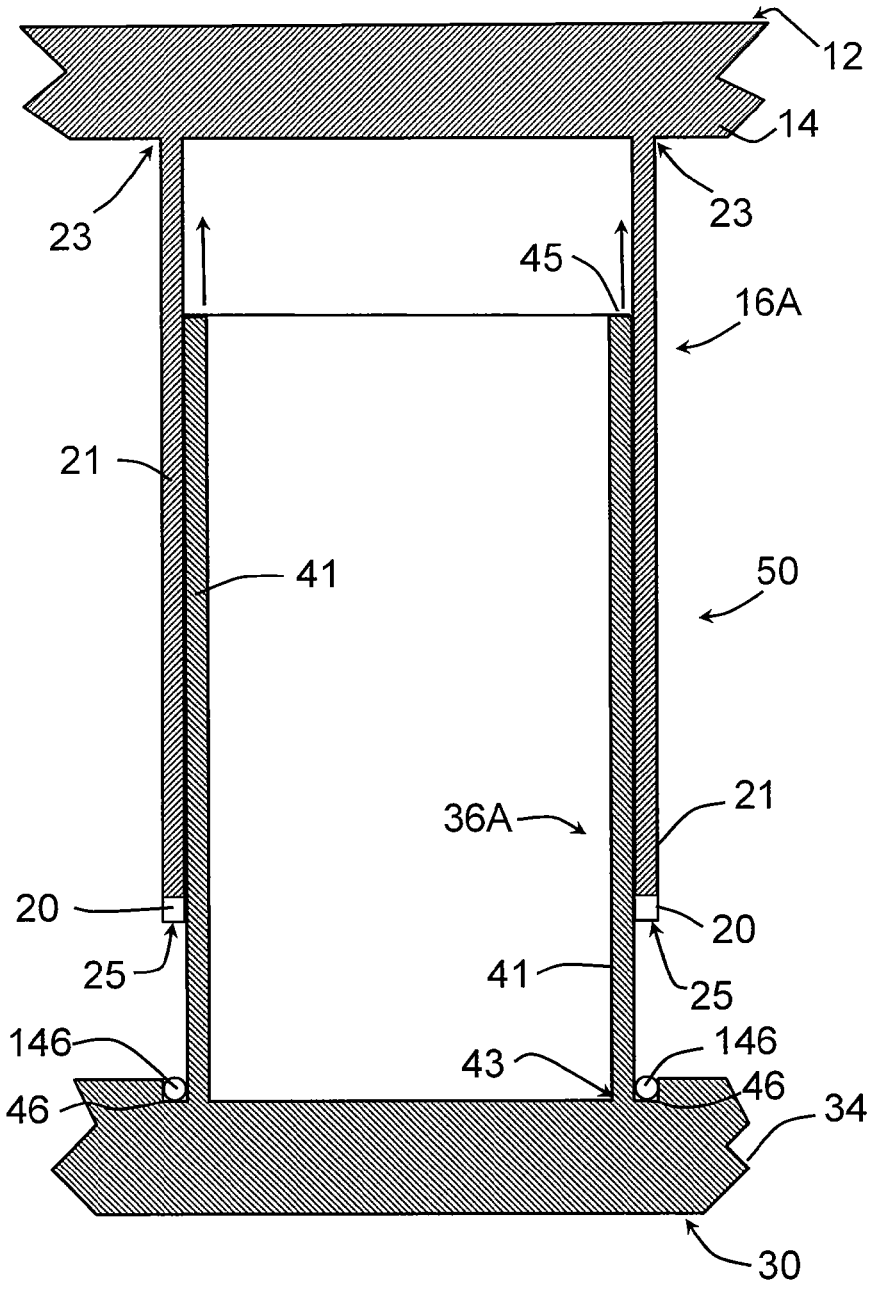
FIG. 8 is a cross-sectional view of along the line 8-8 in FIG. 1 with the top and bottom decks positioned prior to assembly.
Figure 9:
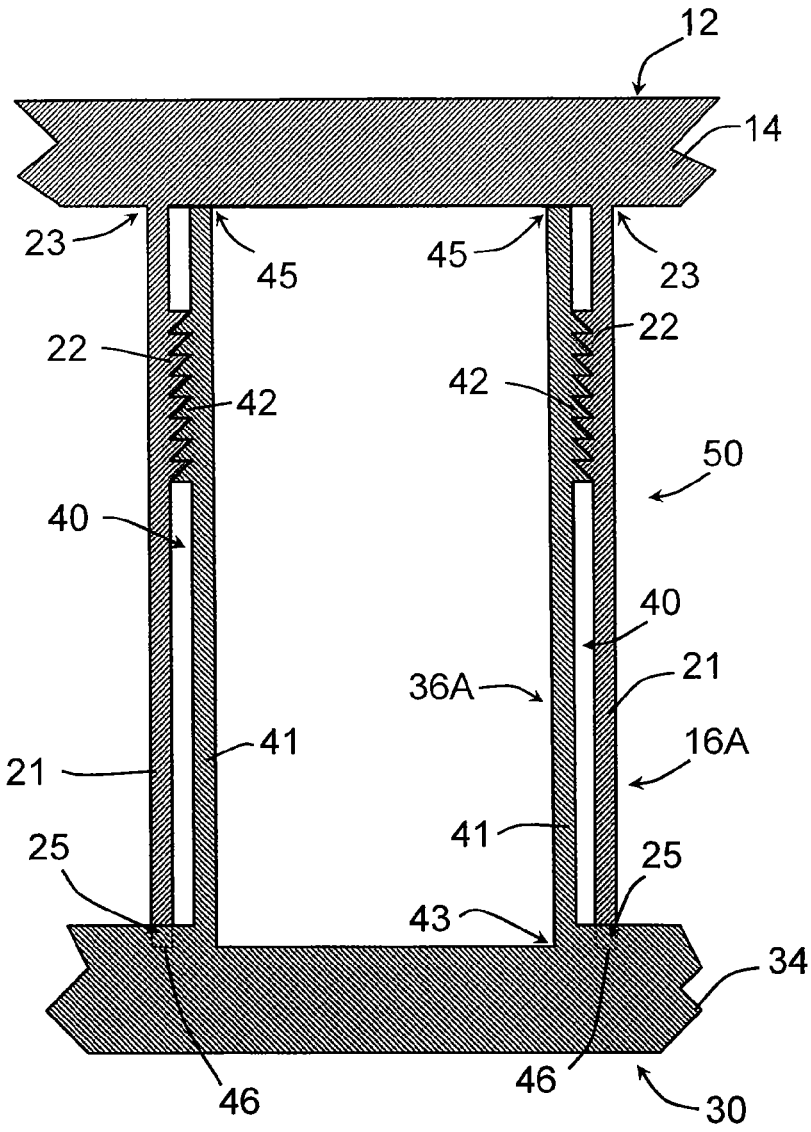
FIG. 9 is a cross-sectional view of along the line 7-7 in FIG. 1 with the top and bottom decks assembled together.

Referring to FIGS. 6 and 8, a groove 46 is provided about the base perimeter of each inner post member 36A-36D. The groove 46 is configured to receive the free end 25 of the respective outer post member 16A-16D as the inner post member 36A-36D is received in the respective outer post member 16A-16D, as illustrated in FIGS. 7 and 8. While the groove 46 may extend completely or partially around the inner post member base 45, in the present embodiment, the groove 46 is interrupted by a bridge 47 adjacent to each inner post recess 40, which will be described hereinafter. The outer post members 16A-16D include corresponding notches 20 along the outer member free ends 25 such that the notches 20 receive the respective bridges 47. Upon complete assembly of a post assembly 50, as illustrated in FIG. 9, the outer post free end 25 is received in the groove 46 and axially and radially restrained therein by the bottom deck structure 34. The outer and inner post walls 21 and 41 are preferably axially dimensioned such that the inner post member free end 45 contacts, and thereby supports, the top deck structure 12 when the outer post member free end 25 is received in the groove 46. Alternatively, the inner post member wall 41 may be shorter such that the inner post member 36A-36D terminates within the outer post member 16A-16D without contacting the top deck structure 12. In another alternative embodiment, an internal groove (not shown) is provided about the internal perimeter of the outer post member base 23 such that the inner post member free end 45 may be received within the top deck structure 12.

With the outer post member free end 25 radially restrained within the groove 46, and the outer and inner post member walls 21 and 41 adjacent to one another, see FIG. 8, the post assembly 50 effectively provides a double walled post. Since the ends of each outer post member 16A-16D are radially restrained by the top and lower decks 12 and 30, any lateral force against a post assembly 50 will be carried by both post members 16A-16D and 36A-36D and both the top deck structure 12 and the bottom deck structure 34. Such a structure makes each post assembly 50 more resistant to lateral sheer stresses which may result, for example, from contact by a fork-lift tine. Additionally, receipt of the bridges 47 in the respective notches 20 makes each post assembly 50 more resistant to twist or the like. As such, the relative position of the outer and inner post members 16A-D and 36A-D is securely maintained and the risk the post members will become inadvertently dislodged due to relative movement or the like is reduced.

An additional advantage of the telescoped post assemblies 50 is illustrated in FIG. 9. With the inner post member 36A-36D within the outer post member 16A-16, and the outer post member free end 25 received in groove 46, the post assembly 50 is effectively sealed against contaminants, such as dirt and debris. The post assembly 50 may be further sealed, for example, for use in hygienic applications, by providing a gasket 146 or the like (see FIG. 8) within the groove 46.

To prevent axial separation of the top and bottom decks 12 and 30, the post assemblies 50 are provided with connectors to interconnect the assemblies. Referring to FIGS. 5-10, where the interconnection of corner post assembly 50 will be described, the inner post member 36A of the present embodiment includes a pair of vertical recesses 40 along its perimeter wall 41. Each recess 40 includes a series of outwardly extending barbs 42. As illustrated in FIG. 7, the barbs 42 have tapered surfaces toward the free end 45 and flat surfaces toward the base portion 43. The barbs 42 are configured to engage inwardly extending barbs 22 correspondingly positioned along the inside of outer post member wall 21. The barbs 22 have tapered surfaces toward the free end 25 and flat surfaces toward the base portion 23. Accordingly, as the top deck 12 is positioned on the bottom deck 30 and the inner post member 36A is received in the outer post member 16A, the barb tapered surfaces slide over one another. Upon complete assembly, as illustrated in FIG. 9, the flat surfaces of barbs 22 engage the flat surfaces of barbs 42 and thereby prevent axial separation of the post members 16A and 36A.

Figure 7A:
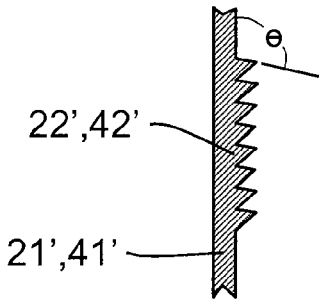
FIGS. 7A and 7B are partial sectional views similar to FIG. 7 showing alternative exemplary barb configurations.
Figure 7B:
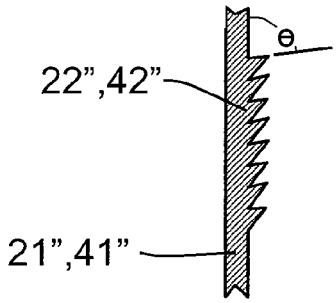

While the flat surfaces of the barbs 22 and 42 of the present embodiment are at substantially right angles to the axis of the post members 16, 36, the angle may be larger or smaller than 90°. For example, FIG. 7A shows the flat surfaces of the illustrated barbs 22', 42' extending at an angle θ relative to the associated wall 21', 41' that is greater than 90°. If the angle θ is for example 91° or more, a force sufficient to pull the telescoped legs apart will not be as damaging to the barbs 22', 42' because they will have more of a tendency to slide apart, although not freely. Conversely, FIG. 7B shows the flat surfaces of the illustrated barbs 22", 42" extending at an angle θ" relative to the associated wall 21", 41" that is less than 90°. For example, an angle θ" of 89° may further lock the barbs 22" and 42" together, making it more difficult to separate the post members 16, 36, if such is desired. The useful angles and degree of distortion can be adjusted based on the mechanical properties and configuration of the material of the post members 16, 36 and associated barbs.

As seen in FIGS. 2 and 3, inner post members 36B and 36C each have two recesses 40 along each long wall, with corresponding barbs 42 in each recess 40, for a total of four sets of barbs 42 on each inner post member 36B, 36C. Outer post members 16B and 16C have corresponding inwardly extending barbs 22 configured to align with the respective barbs 42 such that each outer post member 16B, 16C has four sets of barbs 22. Central inner post member 36D has two recesses 40 along each of its four walls with corresponding barbs 42 in each recess 40, for a total of eight sets of barbs 42 on the central inner post member 36D. Central outer post member 16D has corresponding inwardly extending barbs 22 configured to align with the respective barbs 42 such that the central outer post member 16D has eight sets of barbs 22.

To prevent the inner post member walls 41 from deflecting, and thereby increasing the risk of in advertent disengagement of the barbs 42 and 22, vertical ribs 55 are preferably provided within the inner post members 36A-36D. The vertical ribs 55 preferably extend between opposed recesses 40, but may be provided in additional locations, as illustrated. The vertical ribs in the inner post members 36A are reduced in height, to facilitate receipt within the post member of rack legs or the like as described above with reference to FIG. 4, and are not visible in the figures.

To facilitate the relative sliding between the barbs 22 and 42, and minimize the risk of damage therebetween, each of the inner post barbs 42 of the present embodiment includes a contoured edge 51 as illustrated in FIG. 10. Each contoured edge 51 is arcuate in shape such that the lateral edges 53 of each barb 42 are recessed. The contoured edges 51 minimize contact during interconnecting sliding, but do not minimize the effective holding strength of the barbs 22 and 42 based on the flat surface contact.

Figure 6A:
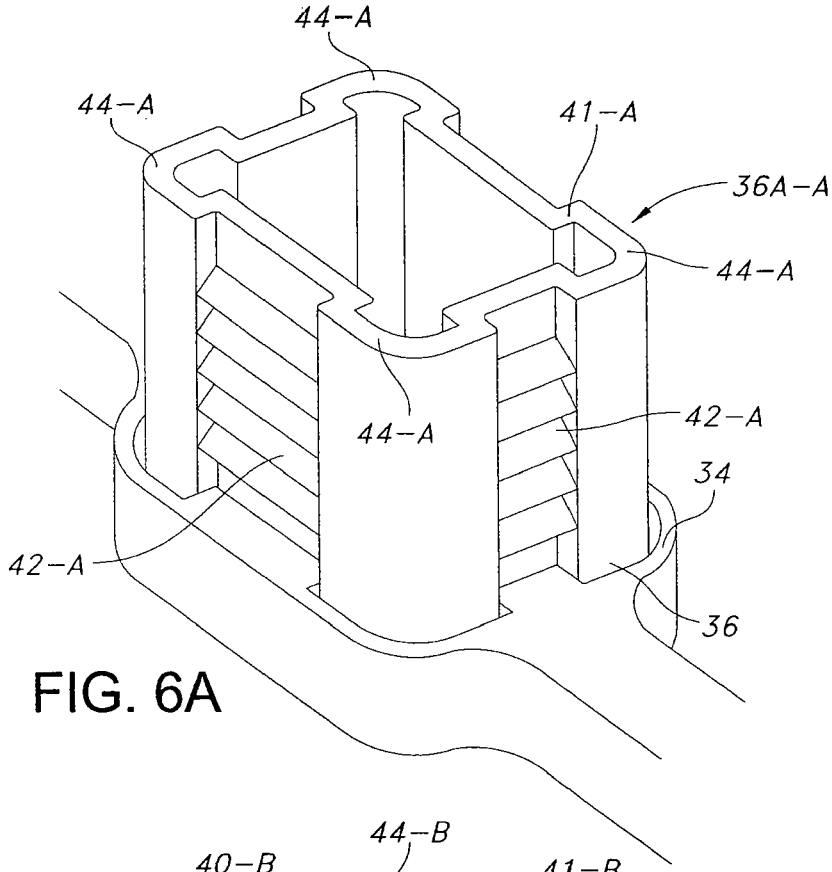
FIG. 6A is a top isometric view of an alternative illustrative inner post member.
Figure 6B:
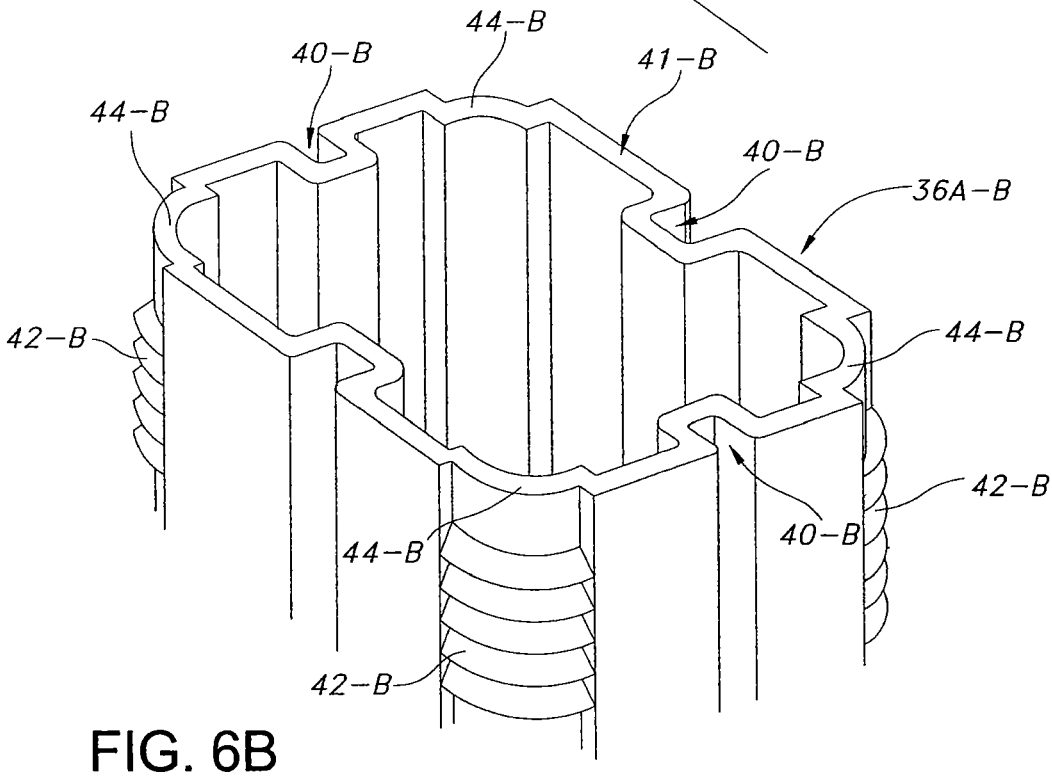
FIG. 6B is a top isometric view of another alternative illustrative inner post member.

Referring to FIGS. 6A and 6B, it illustrated that the posts may have alternative configurations. For example, in the exemplary inner post member 36A-A illustrated in FIG. 6A, the perimeter wall 41-A has a curved or arcuate configuration between the corners 44-A. The barbs 42-A, instead of being positioned on a flat is surface and having a curved edge, are positioned along the curved wall 41-A surfaces and have a contour which corresponds to that of the wall 41-A. The outer post member (not shown) has an internal configuration which complements the curved configuration of the inner post member 36A-A.

In the exemplary inner post member 36A-B illustrated in FIG. 6B, the barbs 42-B are provided at the corners 44-B of the perimeter wall 41-B. A vertical channel 40-B or the like is desirably provided between each set of corners 44-B. The vertical channels 40-B are configured to allow slight compressing of the walls 41-B as the inner post member 36A-B is engaged with the outer post member (not shown). Upon engagement, the walls 41-B return to their non-compressed condition, and the corner barbs 42-B engage corresponding corner barbs on the outer post member. Other configurations of the post assemblies, for example, the wall shape and barb placement, are within the scope of the invention.

An alternate barb configuration, also configured to facilitate sliding between the barbs, is illustrated in FIGS. 11A-11D. In the present embodiment, the barbs 22*a*-22*d* on the outer post member 16A' have different axial widths and the barbs 42*a*-42*d* on the inner post member 36A' have different axial widths and varied axial spacing therebetween. The barbs 22*a*-22*d* have axial widths a, b, c, d, respectively, that decrease moving from the widest barb 22*a* closest to the outer post member free end 25 toward the narrowest barb 22*d* spaced furthest from the outer post member free end 25. Correspondingly, the barbs 42*a-d* are configured and spaced from one another such that the axial spacing x, y, z, respectively, between adjacent barbs increases moving from the narrowest space x between barbs 42*a* and 42 *b*, to the widest space z between barbs 42*c* and 42*d*. As the post members 16A' and 36A' are brought toward one another as illustrated in FIG. 11B, the tapered surfaces of barbs 22*a* and 42*a* ride along one another and flex the walls 21 and 41 outward to allow the barbs to slide past one another. Referring to FIG. 11C, since barb 22*a* has a width "a" that is greater than any of the spaces x, y, z, the flat surface of barb 22*a* slides along the flat surfaces of barbs 42*a*-42*d* without entering any of the spaces x-z therebetween. As illustrated in FIG. 11D, each barb 22*a*-22*d* only fits into one corresponding space between the barbs 42*a*-42. As such, the barbs will slide along their flat surfaces and will not repeatedly engage and re-ramp on successive barbs as the outer and inner post members 16A' and 36A' are moved relative to one is another.

Figure 12:
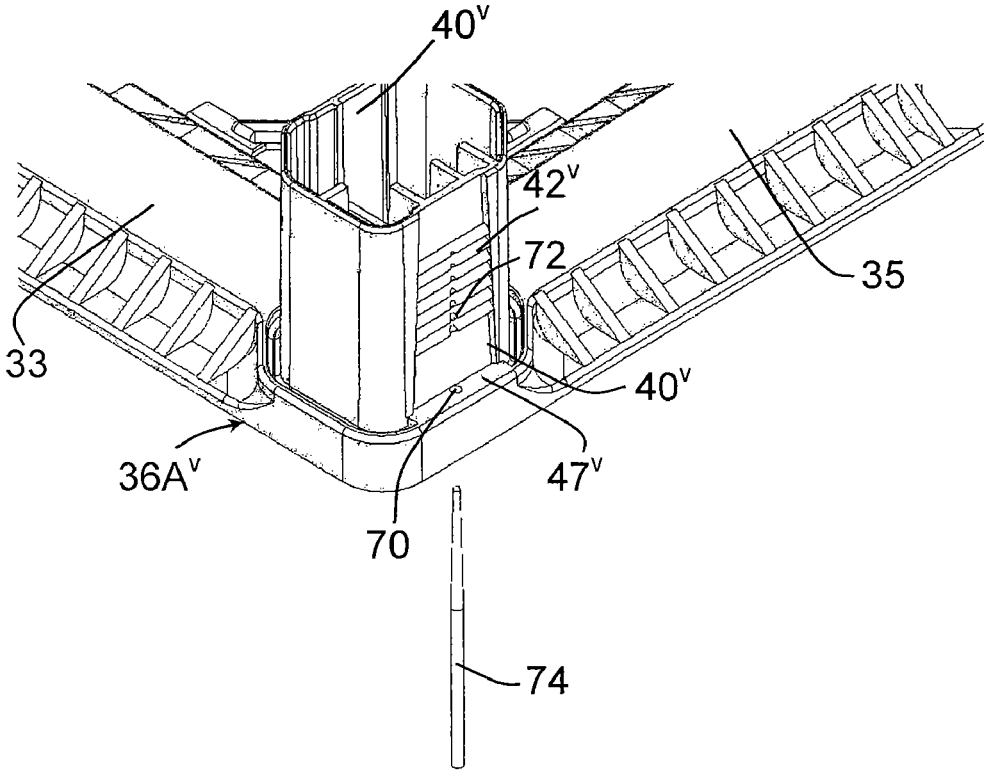
FIGS. 12 and 13 are partial isometric views of an alternative post assembly incorporating an exemplary disengagement tool.
Figure 13:
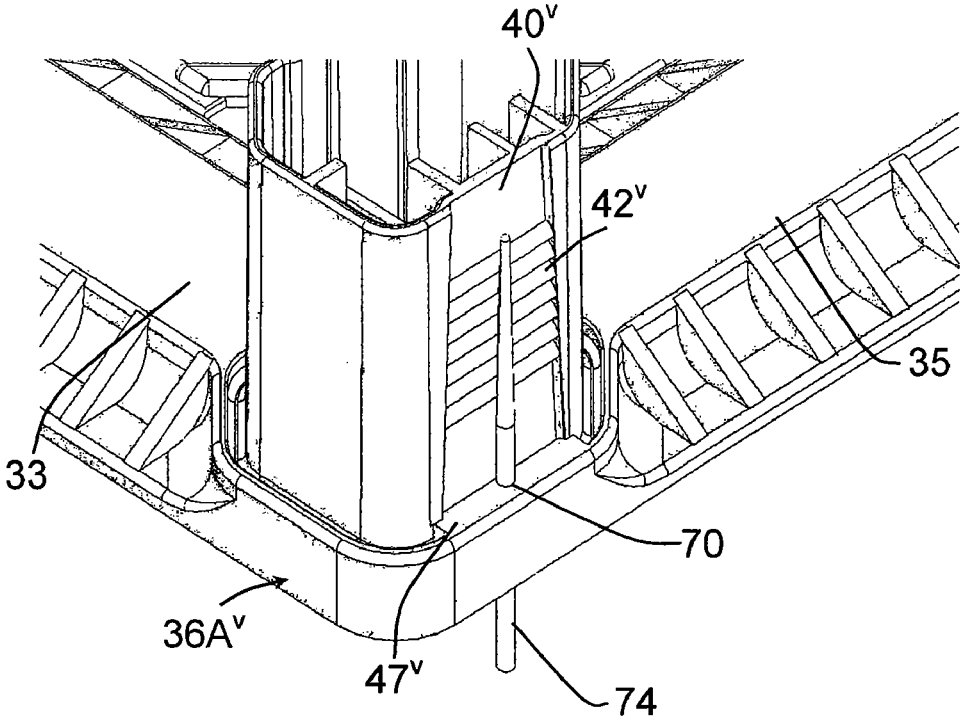
Figure 14:
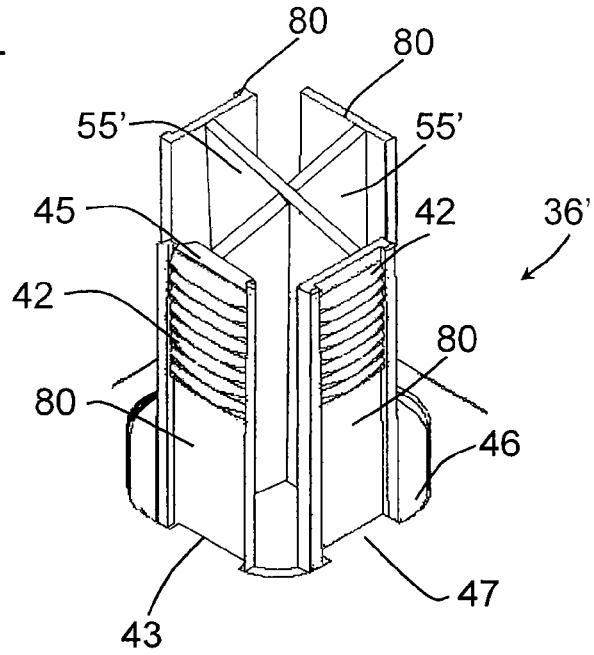
FIG. 14 is a top isometric view of an alternative illustrative inner post member.

While it is generally preferred that the engagement of the barbs 22, 42 securely locks the post members 16, 36 together, it may be desirable to separate the post members 16, 36, for example, in order to repair a pallet by replacing a top or bottom section. Referring to FIGS. 12 and 13, an exemplary method of disassembling the post members 16 and 36 with minimal damage thereto will be described. A disengagement through hole 70 (only one shown) is provided through each bridge 47$^{v}$ aligned with each recess 40$^{v}$ of the post member 36A$^{v}$. The through hole 70 is configured to receive a disengagement tool 74 therethrough.

Figure 16:
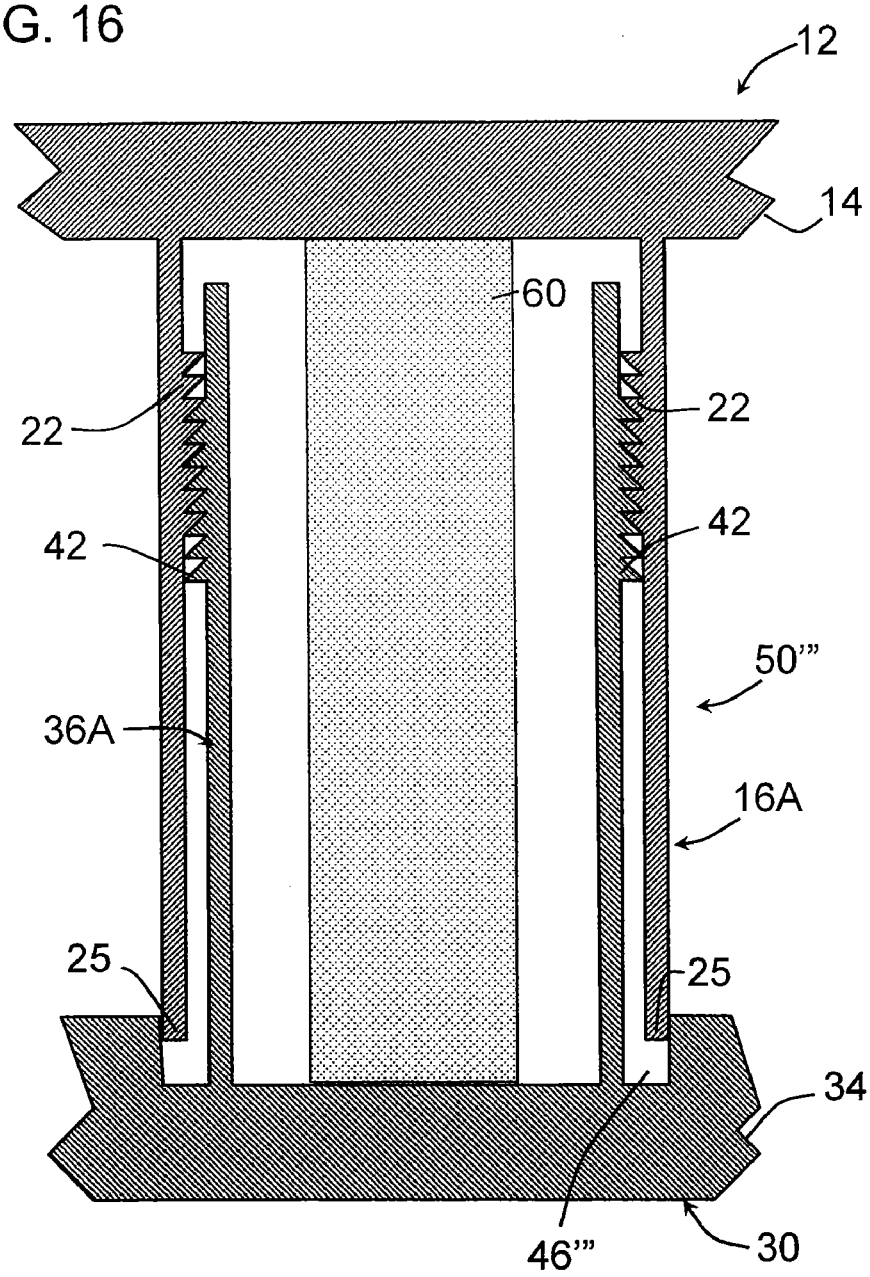
FIG. 16 is a cross-sectional view of another alternative post assembly in a partially interconnected position.

As illustrated in FIG. 16, the disengagement tool 74 is configured to engage each of the inner post member barbs 42$^{v}$ and the opposed outer post member barbs (not shown). Preferably, at least one of the inner post member barbs 42$^{v}$ or the opposed outer post member barbs (not shown) includes curved recesses 72 in the outer edges of the barbs to guide the disengagement tool 74. As the tool 74 is advanced through the hole 70 and between the barbs, the wedging effect distorts the post member walls enough to allow disengagement of the barbs. It is noted that the disengagement tool 74 may have a tapered profile with the recesses 72 having a corresponding shallowing to facilitate easier passage of the tool 74 through the hole 70 and between the barbs. To completely disassemble the pallet 10, it is preferred to simultaneously engage a multiple of tools 74 in most, if not all post assemblies 50 of the pallet 10 in order to get the pallet 10 apart. The tool 74 can be manufactured from various materials, for example, a hard plastic or the like.

Figure 17:
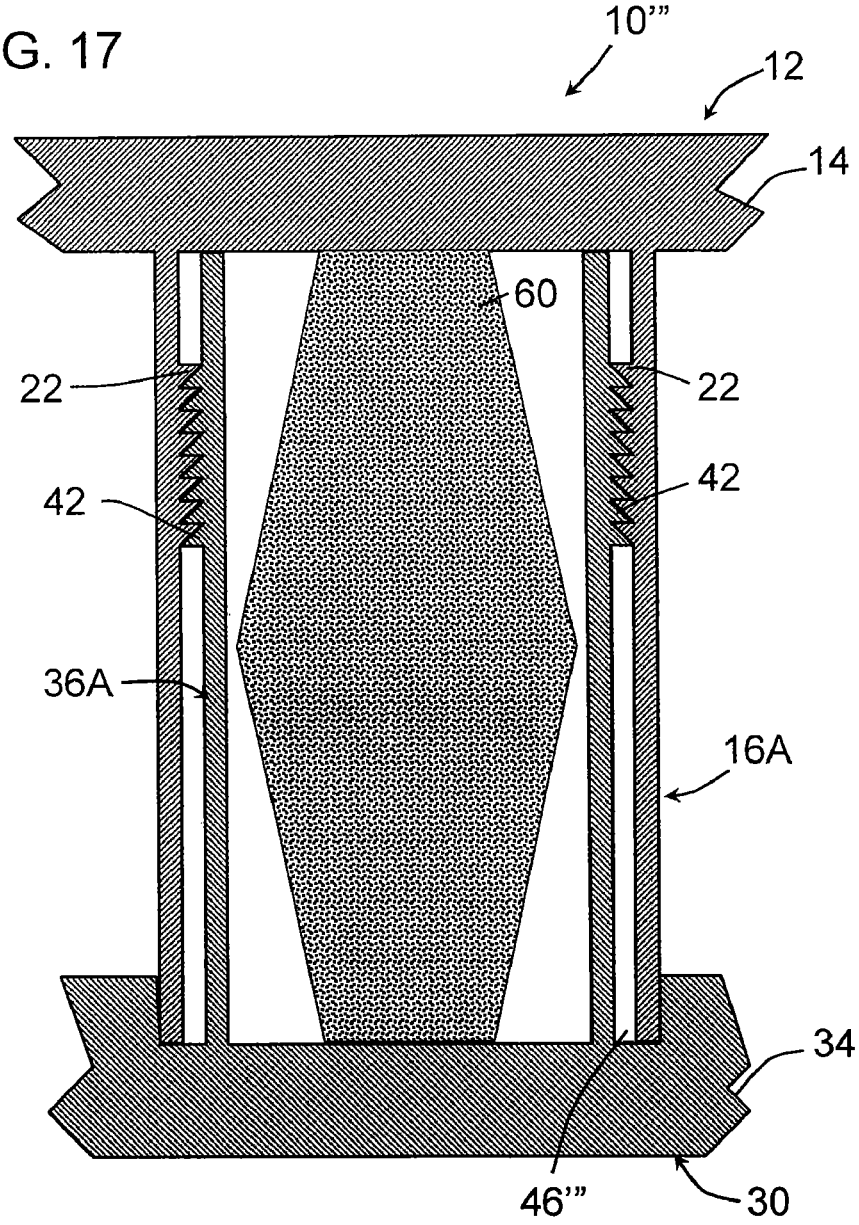
FIG. 17 is a cross-sectional view of the post assembly of FIG. 16 in a fully interconnected position.

Referring to FIG. 17, an inner post member 36' that is an alternative exemplary embodiment is described. The inner post member 36' is similar to the previous embodiments, however, does not include a continuous wall extending from adjacent the base portion 43 to a free end 45. In the present embodiment, the inner post member 36' is defined by a plurality of finger members 80 extending from the base portion 43 to a free end 45. The finger members 80 are supported relative to one another by vertical ribs 55' or the like. In the present embodiment, each finger member 80 is provided with barbs 42 configured to engage corresponding barbs on the outer post member 16. A groove 46 is provided about the base portions 43 of the finger members 80 and may include one or more bridges 47. Use and operation of the inner post member 36' is substantially the same as in the previous embodiments. The is groove 46 is configured to receive the free end of the outer post member 16 as in the previous embodiment. While four finger members 80 are illustrated, more or fewer may be utilized. Additionally, barbs 42 or the like are not required on each of the finger members 80.

Figure 15:
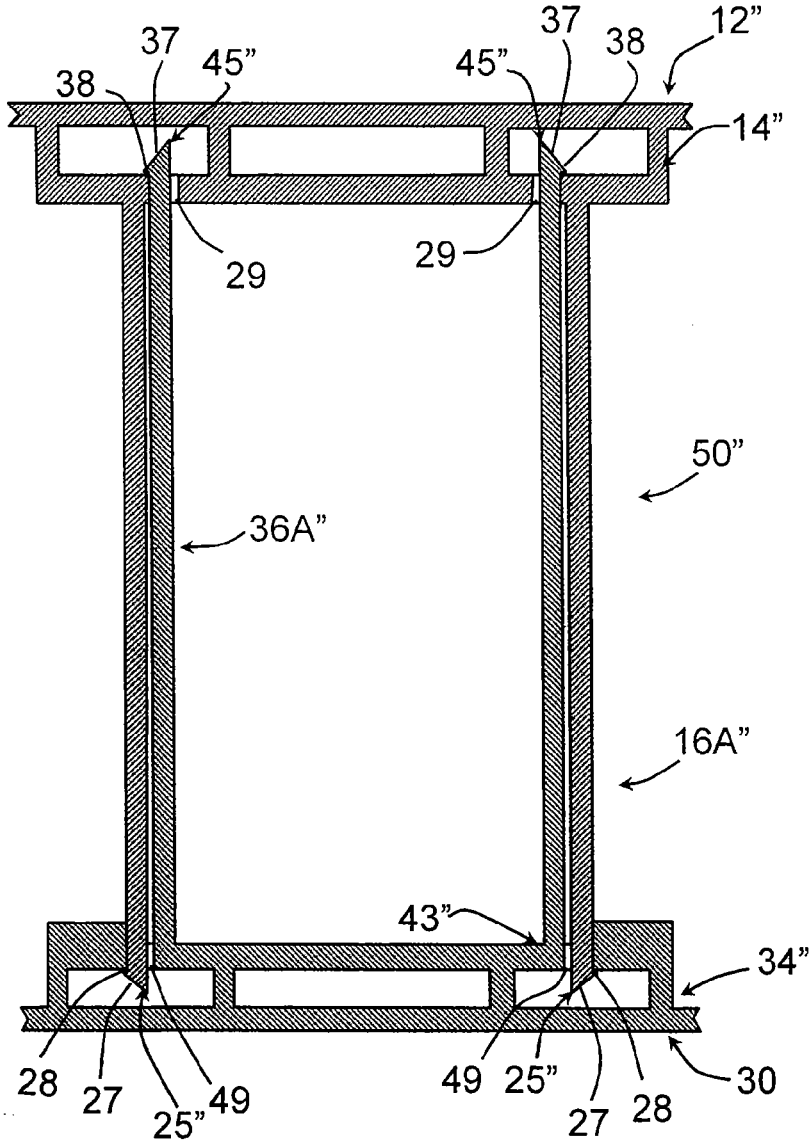
FIG. 15 is a cross-sectional view of an alternative post assembly.

Referring to FIG. 15, an alternate connector assembly is described. In the present embodiment, the post assembly 50" includes an outer post member 16A" configured to engage and secure relative to the deck structure 34" of the lower deck 30". A groove 46" is provided about the base 43" of the inner post member 36A". A plurality of through holes 49 are provided within the groove 46". The outer post member free end 25" includes a plurality of tapered fingers 27 configured to pass through the respective through holes 49. Each finger 27 has an outward projection 28 configured to engage a portion of the deck component 34" after the tapered finger 27 is positioned through the through hole 49. Engagement of the projections 28 with the deck component 34" interconnects the outer post member 16A" to the lower deck 30", thereby interconnecting the top and lower decks 12" and 30". To further strength the interconnection, the inner post member 36A" may be provided with tapered fingers 37 at its free end 45" configured to pass through through holes 29 in the top deck structure 12. Similarly, the fingers 37 include projections 38 configured to engage a portion of the top deck 12" after the tapered finger 37 is positioned through the through hole 29. While the tapered fingers 27, 37 pass through the through holes 29, 49, the remainder of each free end 25", 45" contacts the respective opposed deck 30", 12", thereby supporting the decks 12" and 30" in spaced relationship.

An alternative embodiment of the present invention is illustrated in FIGS. 16 and 17. The pallet 10''' is substantially the same as the pallet 10 illustrated in FIGS. 1-3 and like elements are numbered the same. The pallet 10''' is configured for air dropping of supplies or the like. In this regard, each post assembly 50''' includes a compression material 60 therein. The inner post members 36A-36D telescope within the outer post members 16A-16D and the compression material 60 is positioned between the top and bottom decks 12 and 30. The compression material 60 is configured to support the decks 12 and 30 in the initial position illustrated in FIG. 16 wherein the inner post member 36A-36D is not fully received within the outer post member 16A-16D. The grooves 46''' are preferably deeper than in the embodiment illustrated in FIGS. 1-3, such that the outer post member free ends 25 may be received and radially retained within the grooves 46 in this initial position. The barbs 22 and barbs 42 are partially engaged and prevent the top and bottom decks 12 and 30 from axially separating.

In the initial position, the pallet 10''' is ready for loading. The compression material 60 is preferably selected such that it will maintain the initial position even upon loading of the pallet 10'''. After the pallet 10''' is loaded, it may be transported via airplane or the like from which it can be dropped. When the pallet 10''' lands, the compression material 60 absorbs some of the impact as the top deck 12 moves toward the bottom deck 30 to the position illustrated in FIG. 17. The barbs 22 and 42 are free to further ratchet and the outer post member free end 25 is free to move further into the groove 46'''. The compression material 60 allows the pallet 10''' to absorb some of the impact will maintaining a useable configuration. The compression material 60 may be a solid or a fluid. As an example, the compression material 60 may be a compression spring or a block of urethane foam, or any other material selected with the desired compressibility.

Figure 18:
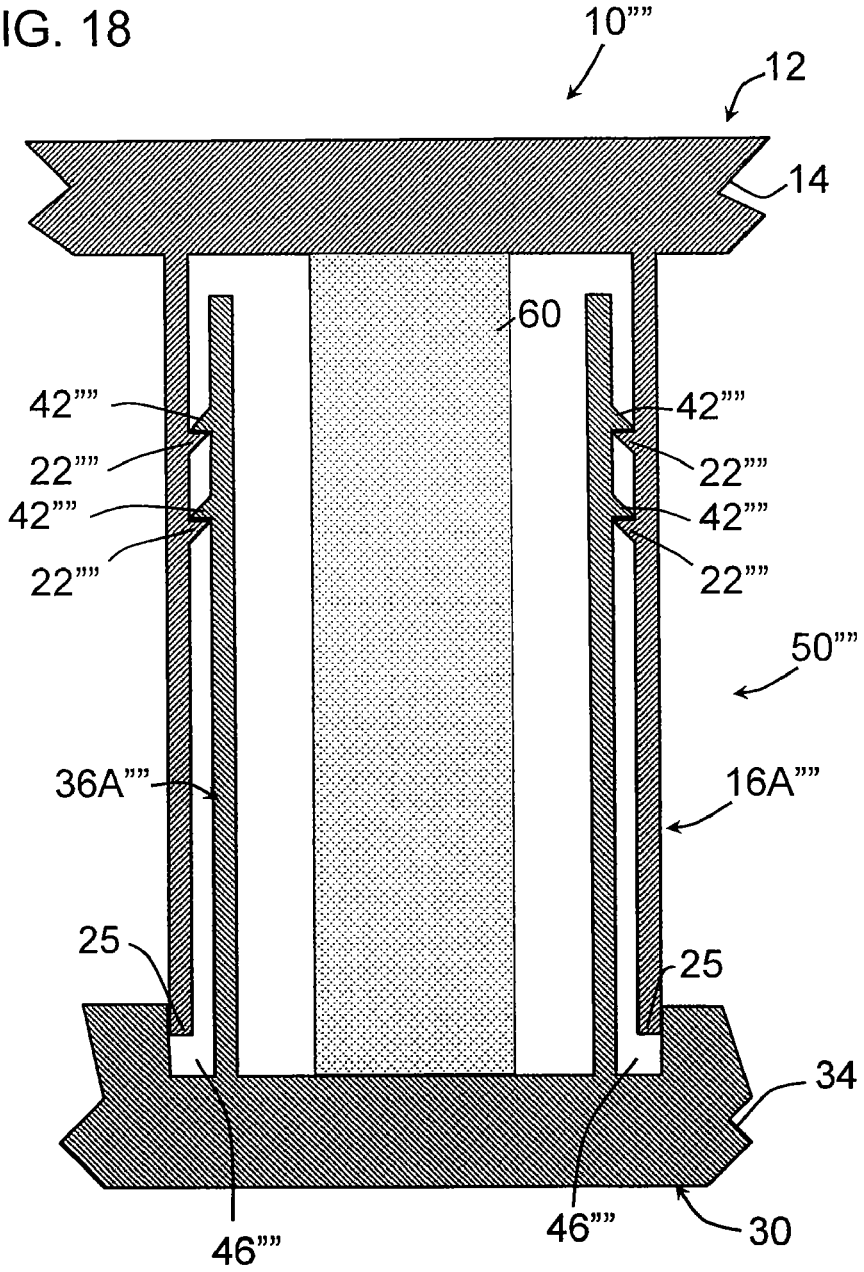
FIG. 18 is a cross-sectional view of another alternative post assembly in an initial interconnected position.
Figure 19:
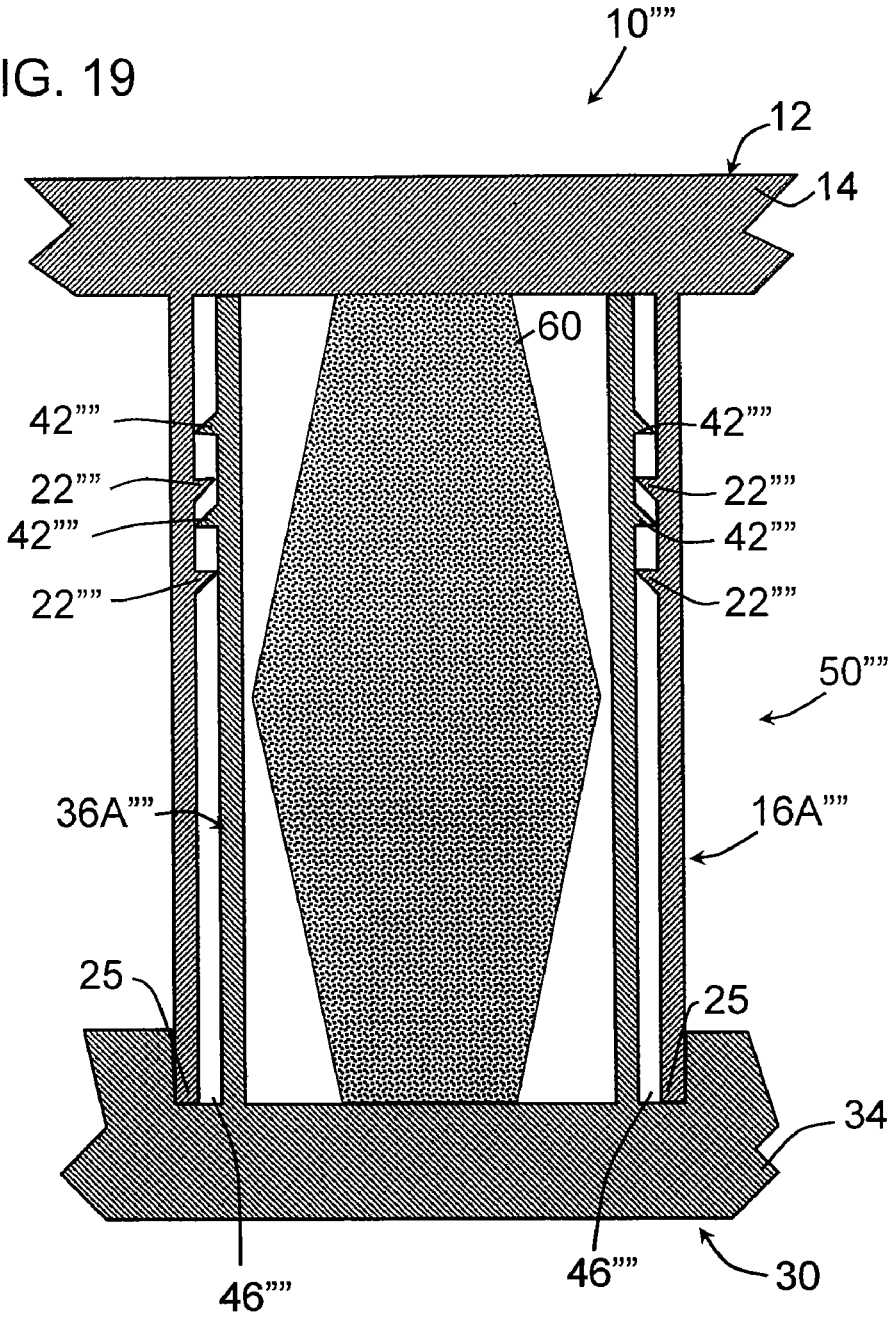
FIG. 19 is a cross-sectional view of the post assembly of FIG. 18 in a compressed interconnected position.

Referring to FIGS. 18 and 19, a pallet 10'''' that is another alternative embodiment of the present invention is illustrated. The pallet 10'''' is again substantially the same as the pallet 10 illustrated in FIGS. 1-3 and like elements are numbered the same. The pallet 10'''' is configured to provided continuous shock absorption during use. In this regard, each post assembly 50'''' includes a compression material 60 therein. The inner post members 36A''''-36D'''' telescope within the outer post members 16A''''-16D'''' and the compression material 60 is positioned between the top and bottom decks 12 and 30. The compression material 60 is configured to support the decks 12 and 30 in the initial position illustrated in FIG. 18 wherein the inner post member 36A''''-36D'''' is not fully received within the outer post member 16A''''-16D''''. The compression material 60 is preferably selected such that it will maintain the initial position even upon loading of the pallet 10''''. The grooves 46'''' are preferably deeper than in the embodiment of FIGS. 1-3 such that the outer post member free ends 25 may be received and radially retained within the grooves 46 in this initial position.

In the present embodiment, the barbs 22'''' are axially spaced from one another and the barbs 42'''' are similarly axially spaced from each other. In the initial position illustrated in FIG. 18, the barbs 22'''' engage the barbs 42'''' and thereby prevent the top and bottom decks 12 and 30 from axially separating. However, the axial spacing of the barbs 22'''', 42'''' allows the outer post members 16A''''-16D'''' to move relative to the inner post members 36A''''-36D'''', thereby allowing the top deck 12 to move relative to the bottom deck 30 against the force of the compression member 60. As such, if the pallet 10'''' is being transported and encounters a rough ride, the top and bottom deck members 12 and 30 may move relative to one another, with the compression material 60 absorbing the force caused by the rough ride, and thereby reducing the force on the items positioned on the pallet 10''''. As in the previous embodiment, the compression material 60 may be a solid or a fluid and may be selected from various materials.

Figure 20:
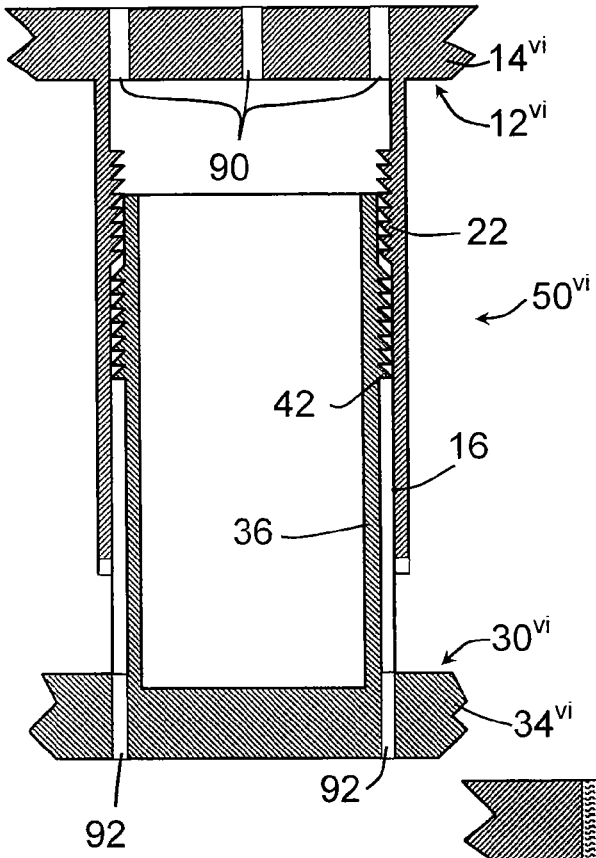
FIG. 20 is a cross-sectional view of another alternative post assembly in a partially interconnected position.
Figure 21:
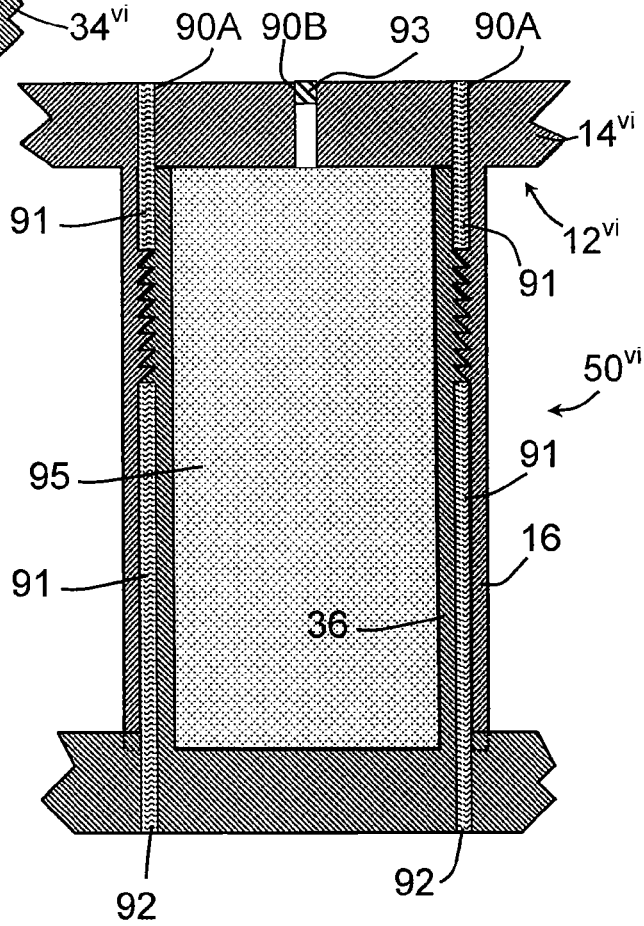
FIG. 21 is a cross-sectional view of the post assembly of FIG. 20 in a fully interconnected position.

While the deck surfaces in the various embodiments are preferably continuous proximate the post assemblies, such that debris and the like is prevented from entering within the post assembly, in some applications through holes are necessary or desired. For example, in the post assembly 50$^{vi}$ illustrated in FIGS. 20 and 21, various through holes 90 and 92 are provided through the deck surfaces 14$^{vi}$ and 34$^{vi}$ of the top and bottom decks 12$^{vi}$ and 30$^{vi}$, respectively. The through holes 90, 92 may be provided, for example, to simplify molding of the barbs 22, 42 or to facilitate positioning of a dampening material 95 within the post assembly 50$^{vi}$. After assembly of the post assembly 50$^{vi}$, it is often desirable to seal the through holes 90 and 92. In the present embodiment, some of the through holes 90A and 92 are sealed with a self expanding sealing foam 91. Alternatively, the through hole 90B may be sealed with a cap 93 or the like which may be secured via a friction fit, adhesion, bonding or any other desired method. The sealed post assembly 50$^{vi}$ prevents debris or the like from entering therein.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A pallet comprising:

first and second decks;

at least two post assemblies extending between the first and second decks to maintain the first and second decks at a distance from one another, each post assembly comprising:

an outer post member including a substantially hollow tubular body extending axially from a base connected to the first deck to a free end spaced therefrom, the tubular body defining an outer post inner wall surface therein and the free end defining the perimeter of the hollow tubular body; and an inner post member including a body extending axially from a base connected to the second deck to a free end spaced therefrom, the inner post member body defining an inner post outer wall surface, the inner post member including a groove extending about at least a portion of the perimeter of the inner post base; wherein, in an assembled configuration, the inner post body free end is received within the outer post body with the inner and outer posts positioned relative to one another and to the first and second decks such that at least a portion of the outer post hollow body free end is received in the inner post groove such that the outer post hollow body free end is radially supported and restrained by the second deck; and wherein, on at least one of the post assemblies, the inner post outer wall surface includes at least one external barb and the outer post inner wall surface includes at least one internal barb, the inner post barb engaging the outer post barb when the inner post body free end is received within the outer post body and interconnects the first and second decks in the assembled configuration.

2. The pallet according to claim 1 wherein at least one of the inner post outer wall surface is defined by a continuous wall extending between the inner post base and the inner post body free end.

3. The pallet according to claim 2 wherein at least one vertical rib extends between opposed portions of the continuous wall.

4. The pallet according to claim 3 wherein the opposed portions of the continuous wall each have at least one external barb thereon.

5. The pallet according to claim 1 wherein the inner post outer wall surface is defined by a plurality of circumferentially spaced finger members extending between the inner post base and the inner post body free end.

6. The pallet according to claim 5 wherein at least one vertical rib extends between opposed finger members.

7. The pallet according to claim 6 wherein the opposed finger members each have at least one external barb thereon.

8. The pallet according to claim 1 wherein at least one bridge portion is defined within the inner post groove and the outer post free end includes at least one corresponding notch configured to receive the at least one bridge portion.

9. The pallet according to claim 1 wherein each barb has a tapered surface facing toward its respective post free end and a flat engagement surface facing toward its respective post base end.

10. The pallet according to claim 9 wherein each flat engagement surface extends at a substantially right angle relative to an axis extending along the respective post member.

11. The pallet according to claim 9 wherein each flat engagement surface extends at an acute angle relative to an axis extending along the respective post member.

12. The pallet according to claim 9 wherein each flat engagement surface extends at an obtuse angle relative to an axis extending along the respective post member.

13. The pallet according to claim 1 wherein each barb has an arcuate contoured edge.

14. The pallet according to claim 1 wherein the inner post outer wall surface includes a plurality of external barbs configured to engage a plurality of internal barbs on the outer post inner wall surface.

15. The pallet according to claim 14 wherein the external barbs have differing axial widths and are varied axial spacing therebetween and the internal barbs have differing axial widths and are varied axial spacing therebetween such that the external and internal barbs only engage in a given orientation relative to one another.

16. The pallet according to claim 14 wherein the external barbs and the internal barbs are spaced such that in a first orientation the external barbs engage the internal barbs but the first and second decks are moveable relative to one another and in a second orientation the external barbs engage the internal barbs such that the first and second decks are axially fixed relative to one another.

17. The pallet according to claim 16 wherein a compressible material is provided within the post assembly and compresses as the barbs are moved from the first orientation to the second orientation.

18. The pallet according to claim 1 wherein the inner and outer post members define a substantially sealed interior within the post assembly.

19. The pallet according to claim 18 wherein a gasket is provided within the inner post groove.

20. The pallet according to claim 18 wherein the first or second deck includes a through hole which is sealed via a self expanding sealing foam.

21. The pallet according to claim 18 wherein the first or second deck includes a through hole which is sealed via a cap.

* * * * *